United States Patent [19]

Dehner

[11] 4,194,451

[45] Mar. 25, 1980

[54] RAILWAY CAR CENTER SILL

[75] Inventor: James L. Dehner, Poway, Calif.

[73] Assignee: Pullman Incorporated, Chicago, Ill.

[21] Appl. No.: 881,304

[22] Filed: Feb. 27, 1978

[51] Int. Cl.[2] ..... B61D 17/00

[52] U.S. Cl. ..... 105/416; 105/414; 105/413

[58] Field of Search ..... 105/413–420, 105/226–229, 247–248, 11

[56] References Cited

U.S. PATENT DOCUMENTS

| | | | |
|---|---|---|---|
| 757,110 | 4/1904 | Hasen | 105/414 |
| 3,145,666 | 8/1964 | Spence et al. | 105/416 |
| 3,527,171 | 9/1970 | Stark | 105/416 |
| 3,577,934 | 5/1971 | Gutridge | 105/413 |
| 3,954,066 | 5/1976 | Heap | 105/416 |

*Primary Examiner*—Stephen G. Kunin
*Assistant Examiner*—Lawrence E. Williams
*Attorney, Agent, or Firm*—Richard J Myers

[57] ABSTRACT

A reinforcing structure for a railway car having a fish-belly type underframe including a center sill having tapered transition sections connected between the center section of the sill and each end section. At each transition section a pair of longitudinally extending horizontal plates are provided which are contiguous and affixed to the respective vertical webs of the sill and extend from the center section through the transition section and into the end section, thereby directing structurally deleterious fatiguing loads away from the bent portions of the sill at the junctures of the transition section and the center and end sections.

6 Claims, 4 Drawing Figures

RAILWAY CAR CENTER SILL

BACKGROUND OF THE INVENTION

1. Field of the Invention

The present invention relates to a railway car underframe having a fishbelly type center sill and in particular to a reinforcing structure for the transition sections of the center sill.

2. Description of the Prior Art

A fishbelly type center sill for a railway car underframe typically includes a pair of longitudinally extending transversely spaced parallel webs and a top plate and a bottom cover plate secured thereto and conforming to the shape of the webs. The center sill includes a center section, end sections, and transition sections connecting the end sections to the center section. Since the center section is of a considerably deeper and wider design than the end sections, each transition section includes a downward and outward taper which facilitates connecting the sections together as substantially a unitary construction; however, this results in the development of deleteriously high stress concentrations in the bottom coverplate and the vertical webs where it is bent or formed to conform to the cross-section of the center and end sections.

The prior art is exemplified by U.S. Pat. Nos. 3,145,666 and 3,577,934 assigned to Pullman Incorporated and incorporated by reference herein. U.S. Pat. No. 3,145,666 discloses a structure providing for reduced stress concentrations in the transition section by incorporating a plurality of smaller bends in the bottom cover plate of the center sill instead of a single larger bend; and, U.S. Pat. No. 3,577,934 shows a transition section structure having local stiffeners or reinforcing plates which reduce the stresses in the bottom cover plate by locally increasing the cross-sectional area of the load carrying member. Attention is also directed to U.S. Pat. Nos. 998,697 and 1,097,800 which show related fishbelly center sill constructions.

SUMMARY OF THE INVENTION

The present invention relates to an improved reinforcement structure for the transition sections of a fishbelly type center sill. The improvement comprises reinforcing bars or plates welded or otherwise appropriately secured to the webs of the center sill which extend longitudinally from the bottom cover plate in the narrow end sections through the transition sections and terminate in the deep center section of the center sill. By this construction, sever bending and longitudinal impact loading on the transition sections are effectively redirected through the reinforcing bars to bypass the areas of potentially high stress concentration thereby essentially obviating the development of deleterious structurally fatiguing stress concentrations in the bottom cover plate.

DESCRIPTION OF THE PREFERRED EMBODIMENT

Figure 1:
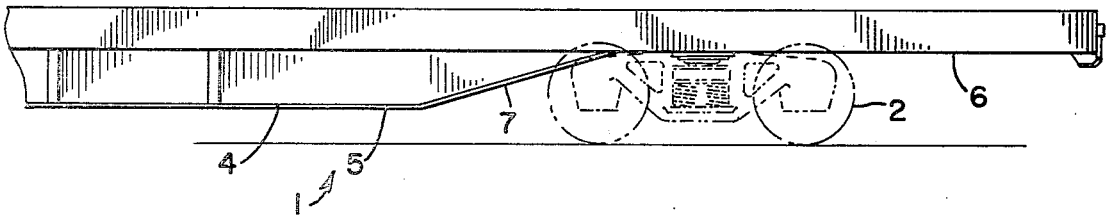
FIG. 1 is a side elevational view partially in section of one end of a fishbelly-type underframe adapted to be supported on railway trucks.
Figure 2:
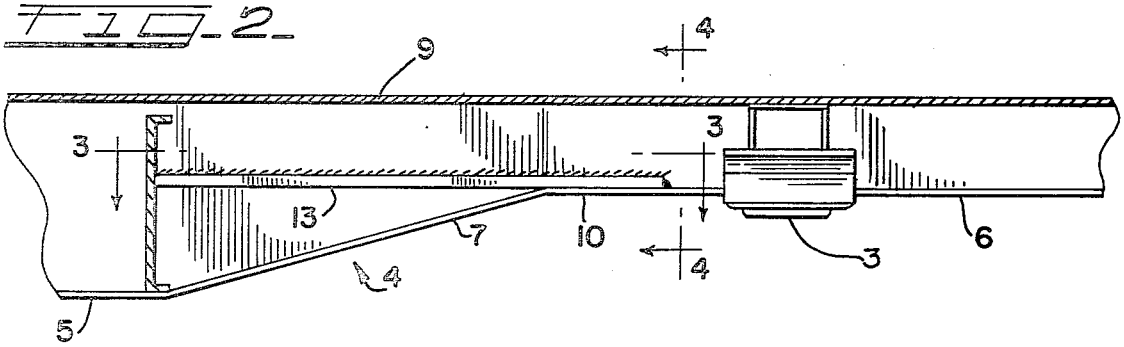
FIG. 2 is an enlarged sectional view of FIG. 1.
Figure 3:
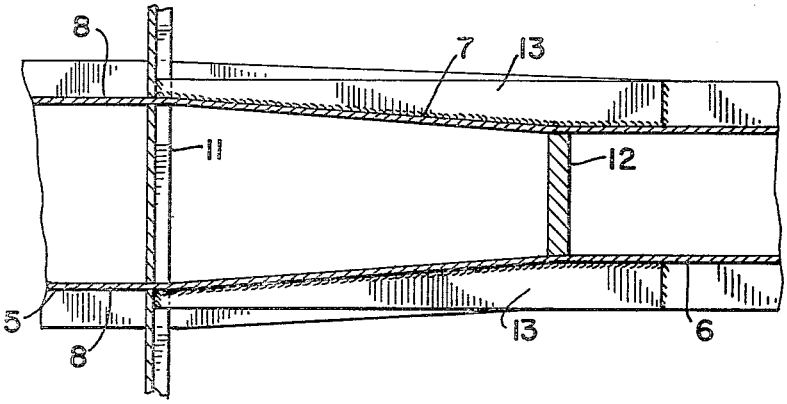
FIG. 3 is a plan sectional view taken along line 3—3 of FIG. 2.
Figure 4:
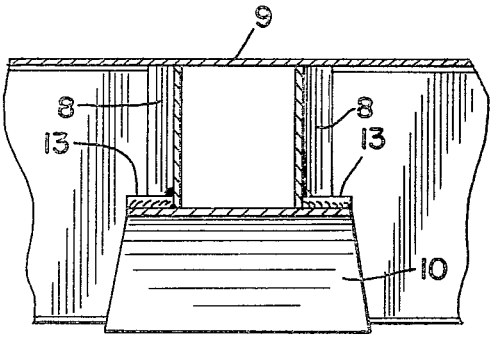
FIG. 4 is a cross-sectional view taken along line 4—4 of FIG. 2.

Turning now to consideration of the drawings, there shown in one end of a fishbelly-type railway car underframe 1 embodying the present invention and adapted to be supported on suitable car trucks 2 through conventional center bearing assemblies 3. The underframe 1 includes a longitudinally extending center sill 4 having a center section 5 and end sections 6 connected to the center section 5 by the transition sections 7. The center sill 4 is generally box-shaped in cross-section and includes transversely spaced vertically extending side webs 8 and an upper cover plate 9 and a bottom cover plate 10 welded or similarly secured to the webs 8 and transversely extending web separators 11 and 12 welded to the vertical webs at the interfaces of the transition sections 7 with the center and end sections 5 and 6, respectively. As can be seen in FIGS. 2–4, since the center section 5 of the center sill 4 is relatively deep and wide and the end section 6 is relatively shallow and narrow, in the transition section 7 the bottom cover plate 10 and vertical side webs 8 are bent or angled at the separators 11 and 12 and converge from the greater cross-section of the center section 5 to the smaller cross-section of the end section 6. Thus, and as discussed above, the present invention contemplates a novel structure effectively reducing or abating excessive stress concentrations in the proximity of the bent or angled portions of the bottom cover plate 10 and the vertical webs 8 resulting from end of car impacts and oscillatory structurally fatiguing sagging or bending of the underframe during rail use.

In the present construction, a tapered bar or plate 13 is welded or otherwise appropriately secured to each of the vertical side webs 8 of the center sill 4. As can be seen in FIG. 3, the tapered plates 13 are secured toand conform to the outboard surface of the vertical webs 8 and extend longitudinally from the bottom cover plate 10 to which they are welded in the narrow end section through the transition section and terminate in the deeper and wider center section longitudinally adjacent or beyond the web separator 11. By this construction, the invention provides a closed stress box or cell formed by the tapered bars 13, the web separator 11, and the bottom cover plate 10 which effectively redirects loads in the bottom cover plate 10 through the tapered bar or plate 13 and the web separator 11 in a manner which has been shown to reduce stress concentrations in the bottom cover plate 10 by as much as fifty percent.

It should be noted that since the tapered plates 13 longitudinally extend entirely through the transition section and are secured to the center and end sections, lateral bending or bulging of the vertical webs 8 is essentially eliminated. Additionally, since the tapered plates 13 are mounted on the outboard surfaces of the vertical webs 8 and can be appropriately positioned to accomplish the desired load redistributing result, the ease and convenience of manufacture is significantly enhanced over those structures heretofore used.

Having disclosed the preferred embodiment of the invention it will be understood by those skilled in the art that various other forms of the invention will come within the scope of the amended claims.

What is claimed is:

1. A center sill for a railway car comprising a center section, opposite end sections, and transition sections between said center and end sections, each of said sections including laterally spaced vertical webs and top and bottom cover plates fixed to said webs, said center section being of greater width and depth than said end sections with said bottom cover plate extending horizontally along said center section and sloping upwardly therefrom through said transition section and continuing horizontally outwardly along said end sections, whereby said bottom cover plate is bent at the ends of each of said transition sections, said vertical webs extending longitudinally along said center section parallel to one another and sloping inwardly toward one another through said transition sections and continuing parallel to one another along said end sections, whereby said vertical webs are also bent at the ends of each of said transition sections, and means for reinforcing the bent portions of said bottom cover plate and said vertical webs at the ends of each transition section including a pair of longitudinally extending horizontal plates, one of said plates being connected to each vertical web and extending from the adjacent portion of the center section of the sill through the transition section and into the end section in substantially the horizontal plane of the end section portion of said bottom cover plate.

2. The center sill according to claim 1, which includes transversely extending web separating plates positioned at the ends of each transition section of the sill and affixed to said vertical webs.

3. The center sill according to claim 1, wherein said longitudinally extending horizontal reinforcing plates are disposed outwardly of said vertical webs.

4. The center sill according to claim 1, wherein said longitudinally extending horizontal reinforcing plates are of a generally tapered configuration to conform to said inwardly sloping portions of said vertical webs.

5. The center sill according to claim 1, wherein said reinforcing plates are welded to said bottom cover plate in said end portions of the sill.

6. The center sill according to claim 1, wherein said longitudinally extending horizontal plates rigidly interconnect said web separating plates associated with each transition section, thereby providing a closed stress cell formed by said horizontal plates said web separating plates and said bottom cover plate.

* * * * *